United States Patent [19]

Phillips

[11] Patent Number: 4,811,971

[45] Date of Patent: Mar. 14, 1989

[54] RIDE-ON VEHICLE

[76] Inventor: Charles B. Phillips, 180 West. End Ave., New York, N.Y. 10023

[21] Appl. No.: 52,913

[22] Filed: May 22, 1987

[51] Int. Cl.[4] ..... A63C 17/02

[52] U.S. Cl. ..... 280/87.041; 280/87.042; D21/227

[58] Field of Search ..... 280/87.04 R, 87.04 A, 280/11.19; 272/70.3, 114; 446/279, 281; D21/227, 224

[56] References Cited

U.S. PATENT DOCUMENTS

| | | | |
|---|---|---|---|
| 1,289,361 | 12/1918 | Bastman | 280/87.04 R |
| 3,565,454 | 2/1971 | Stevenson | 280/87.04 A |
| 3,751,062 | 8/1973 | White, Sr. | 280/87.04 R |
| 4,398,735 | 8/1983 | Evans et al. | 280/87.04 A |
| 4,732,400 | 3/1988 | Santini | 280/87.04 A |

*Primary Examiner*—Charles A. Marmor
*Assistant Examiner*—Richard Camby
*Attorney, Agent, or Firm*—Charles E. Baxley

[57] ABSTRACT

A vehicle combines the features of a skateboard and a scooter. Wheel assemblies are mounted on a tubular structure which provides a frame. A more-or-less oval footplate is also mounted on the tubular structure between the wheel assemblies, and a vertical control stick projects upwardly from the center of the footplate and provides a handle to aid a user in maintaining his or her balance and in keeping control of the vehicle.

1 Claim, 1 Drawing Sheet

RIDE-ON VEHICLE

BACKGROUND OF THE INVENTION

The present invention relates to ride-on vehicles and more particularly to such a vehicle which combines features of a skateboard and a scooter.

It is well known that even experts have problems of maintaining their balance and controlling conventional skateboards, which are therefore dangerous for skateboard riders and others who may simply be pedestrians in the area.

The invention presents a ride-on vehicle which is safer to use than a conventional skateboard, the increase in safety being achieved by giving a user a measure of balance and control which is lacking with conventional skateboards.

It is therefore an important object of the invention to provide a ride-on vehilce which is easier for a user to control than a conventional skateboard.

It is another important object of the invention to provide a ride-on vehicle which is easier for a user to maintain balance than a conventional skateboard.

It is a further important object of the invention to provide a ride-on vehicle which is much safer to use than a conventional skateboard.

It is a further important object of the invention to provide a ride-on vehicle with which the user can perform jumps while keeping a high level of control over the vehicle.

It is a further important object of the invention to provide a ride-on vehicle which can be ridden by two users at the same time.

It is a further important object of the invention to allow a user to ride two of the ride-on vehicles at the same time.

It is a further important object of the invention to provide a ride-on vehicle with which a user can get a running start.

It is a further important object of the invention to provide a ride-on vehicle which allows dance and other self expression modes unattainable heretofore by prior art vehicles of this general type and description.

It is a still further important object of the invention to provide a ride-on vehicle of simple construction and which is not significantly more expensive than a conventional skateboard.

The above and other objects and advantages will appear more fully hereinafter.

SUMMARY OF THE INVENTION

A preferred scootboard vehicle embodying the invention includes a tubular structure which provides a vehicle frame. Wheel assemblies are mounted on the tubular structure, and a more or less oval footplate is also mounted on the tubular structure between the wheel assemblies. A vertical control stick projects upwardly from the footplate and provides a handle to aid a user in keeping his or her balance and in keeping control of the vehicle.

DESCRIPTION OF THE INVENTION

Figure 1:
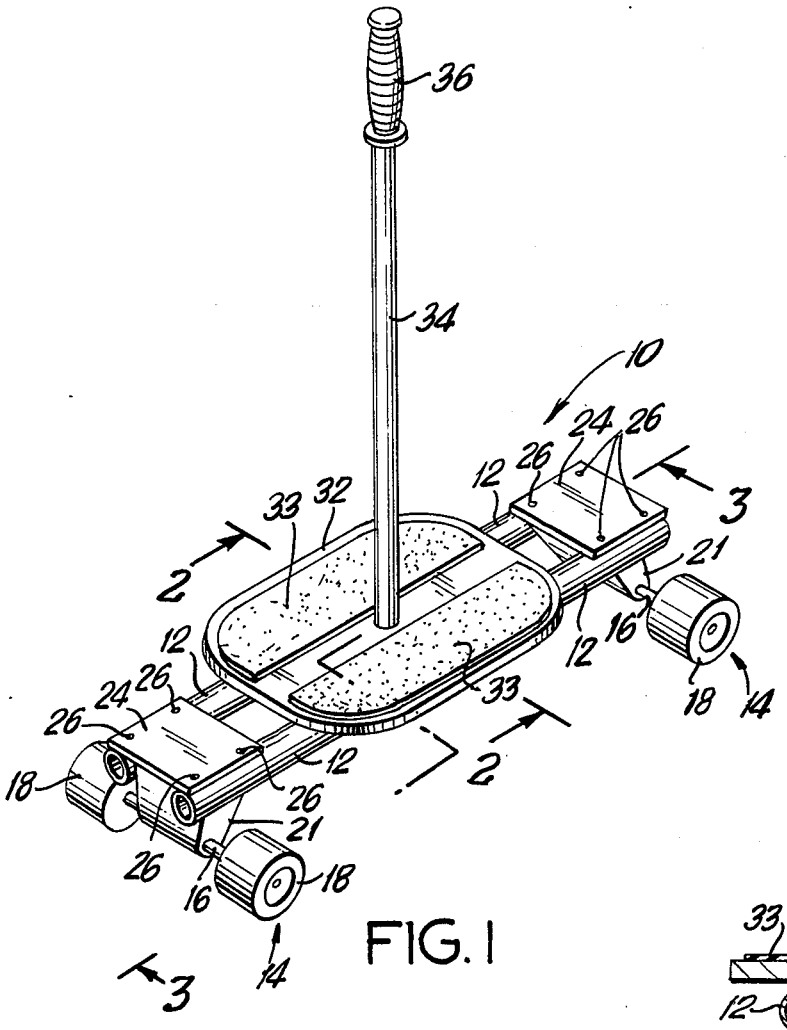
FIG. 1 is a perspective view of a preferred ride-on vehicle embodying the invention.
Figure 2:
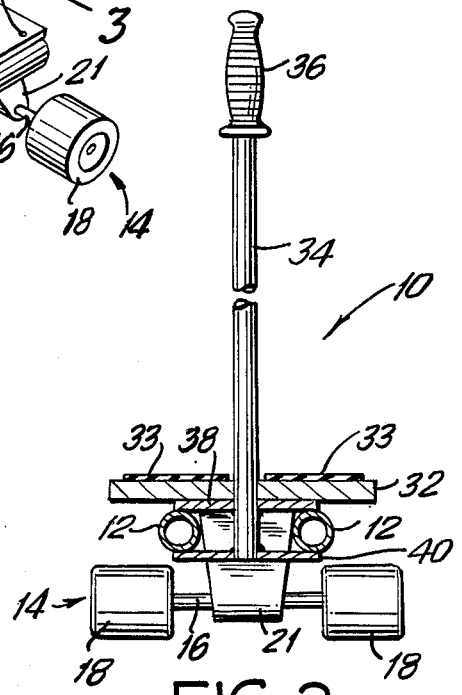
FIG. 2 is sectional view taken along line 2—2 of FIG. 1.
Figure 3:
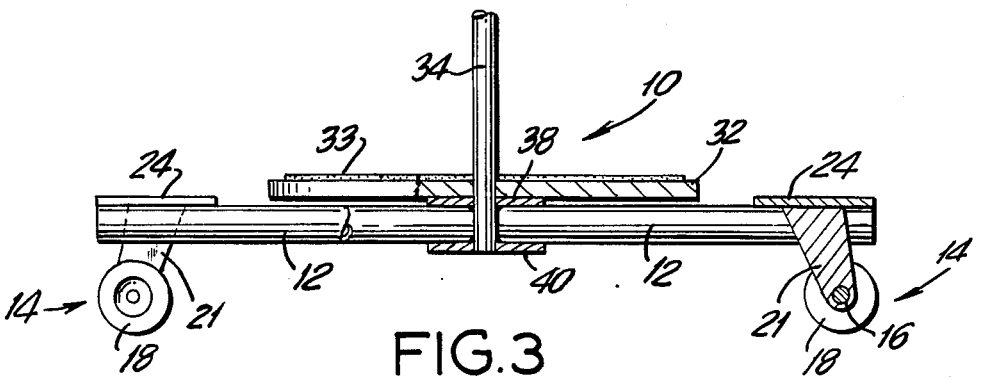
FIG. 3 is a sectional view taken along line 3—3 of FIG. 1.

The various views show a ride-on vehicle 10 comprising a tubular structure providing a frame for vehicle 10. The tubular structure includes a pair of parallel like tubular members 12, each about 21 inches (53.3 cm) long and defining a rectangle, as can be appreciated from FIG. 1. Vehicle 10 further comprises a pair of like wheel assemblies 14, which may be typical skateboard trucks, each having an axle 16, wheels 18 mounted at the ends of axle 16, and, midway between wheels 18, a rectangular mounting plate 24 supported by a bracket 21. Wheel assemblies 14 are secured rigidly to both tubular members 12 at opposite ends thereof by rectangular mounting plates 24, each provided near its four corners with holes 26 therethrough. Screws (not shown) pass through holes 26 and corresponding aligned holes (not shown) through tubular members 12 which are thus clamped to mounting plate 24.

Vehicle 10 also includes a footplate 32 of generally oval configuration and having treads 33, and a control stick 34 passing preferably through the center of footplate 32 and mounted rigidly on tubular members 12 and projecting upwardly about 27 inches (68.6 cm) above footplate 32, to a free upper end having a handle 36 which my be resilient or padded. More particularly, the lower end of stick 34 is rigidly secured preferably to the center of upper and loewr mounting plates 38, 40 which are secured rigidly to tubular members 12 at a location preferably midway between wheel assemblies 14, thus clamping tubular members 12 between mounting plates 38 and 40.

It has been found that control stick 34 gives the user of vehicle 10 balance and control which is completely lacking with conventional skateboards.

The invention well attains the stated objects and advantages and others.

The disclosed details are exemplary only and are not to be taken as limitations on the invention except as those details may be included in the appended claims. For example, the control stick 34 could be to one side, forward or rearward of the center of footplate 32.

I claim:

1. A ride-on vehicle comprising a vehicle frame, said frame including a tubular structure made up of a pair of parallel tubular members lengthwise thereof and spaced apart mounting plates disposed at each of the opposite ends of the tubular members and connecting said tubular members to each other, said mounting plates also having support brackets facing downwardly from the tubular members, wheel assemblies mounted on the downwardly facing portion of said mounting members and wheels disposed therein, a footplate of oval configuration rigidly mounted on and projecting upwardly from said frame the said tubular members and centrally located thereon, a control stick mounted centrally through said oval footplate and rigidly connected to each of said tubular members and projecting upwardly from said oval footplate for aiding the user in maintaining balance and keeping control of said ride-on vehicle, and said control stick being independent of both of said wheel assemblies.

* * * * *